United States Patent [19]

Niederer

[11] 3,952,550

[45] Apr. 27, 1976

[54] KNIT FABRIC INCORPORATING A WARP STITCH WEAVE

[75] Inventor: Kurt W. Niederer, Charlotte, N.C.

[73] Assignee: W. Schlafhorst & Co., Monchengladbach, Germany

[22] Filed: Jan. 6, 1975

[21] Appl. No.: 538,892

Related U.S. Application Data

[62] Division of Ser. No. 423,484, Dec. 10, 1973, Pat. No. 3,884,054.

[52] U.S. Cl. ..... 66/87; 66/84 A

[51] Int. Cl.[2] ..... D04B 23/02

[58] Field of Search ..... 66/86, 87, 84 A, 85, 66/85 A, 19, 190–195

[56] References Cited

UNITED STATES PATENTS

| | | | |
|---|---|---|---|
| 1,286,349 | 12/1918 | Kopp | 66/87 X |
| 1,711,624 | 5/1929 | Vorck et al. | 66/192 X |
| 1,841,165 | 1/1932 | Vorck et al. | 66/84 A UX |
| 2,313,725 | 3/1943 | Amidon | 66/192 X |
| 3,355,911 | 12/1967 | Landgrar | 66/87 X |
| 3,522,716 | 8/1970 | Palange | 66/87 |
| 3,665,733 | 3/1972 | Jackson | 66/87 |

*Primary Examiner*—Ronald Feldbaum
*Attorney, Agent, or Firm*—Richards, Shefte & Pinckney

[57] ABSTRACT

A knit fabric is provided in which warp knit stitch chains are formed at spaces between inlaid warp ends and have loops thereof sinuously interlaced with filling ends laid at opposite sides of the warp ends so that the filling ends are held against the warp ends and both warp and filling ends are caused to interact in a manner producing an appearance approaching that of a woven structure. The method of forming this fabric and means for doing so are also disclosed.

8 Claims, 8 Drawing Figures

KNIT FABRIC INCORPORATING A WARP STITCH WEAVE

CROSS-REFERENCES TO RELATED APPLICATIONS

This is a division of parent application Ser. No. 423,484, filed Dec. 10, 1973, which contains claims to the knit fabric disclosed, and has now been issued as U.S. Pat. No. 3,884,054, on May 20, 1975.

BACKGROUND OF THE INVENTION

Warp stitch chains have heretofore been employed in sewing fashion to bind originally loose base material or elements into a coherent structure. The so-called "Malimo" machine has commonly been used for this purpose, and a representative prior art example is found in U.S. Pat. No. 2,890,579. Also, it has previously been proposed to insert filling in links-links fabric, as in U.S. Pat. No. 3,529,443, and to combine a warp and filling inlay in a knit fabric formed with two sets of knitting ends, as in U.S. Pat. No. 628,818.

Insofar as I am aware, however, it has not heretofore been recognized that woven structure characteristics can be obtained in a knit fabric by interlacing loops of warp stitch chains with the filling of a warp and filling inlay, which the present invention accomplishes advantageously.

SUMMARY OF THE INVENTION

The knit fabric of the present invention incorporates an inlay of spaced warp ends with filling ends laid at opposite sides of the warp ends and is characterized by an improved woven fabric simulation obtained through integrating the warp and filling ends with warp knit stitch chains formed between the warp ends so that the stitch chain loops are sinuously interlaced with the filling ends. The result is a knit fabric having a woven apearance and many of the physical properties of a woven structure, as well as a good range of patterning possibilities.

The knit fabric thus provided, together with the method of forming it and means for doing so, is described in further detail below in connection with the accompanying drawings.

DETAILED DESCRIPTION OF THE INVENTION

Figures 1, 2, 3, 4:
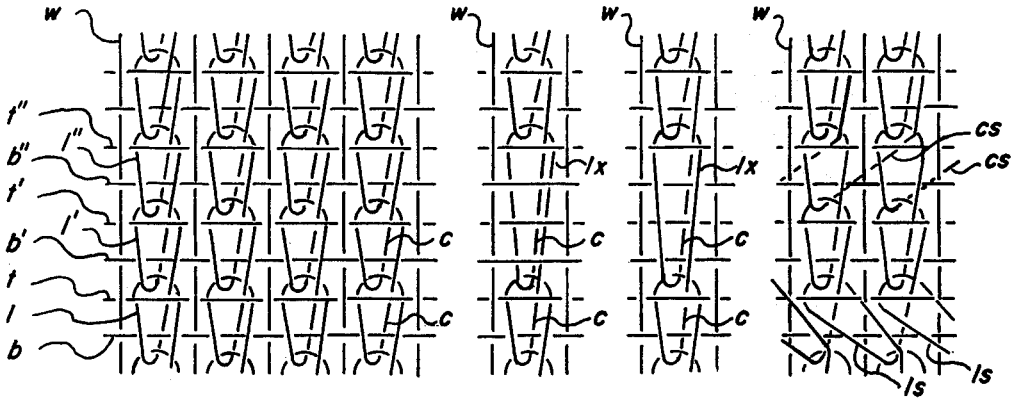
FIG. 1 is a diagram of a portion of knit fabric formed according to the present invention.
FIGS. 2, 3 and 4 are comparable diagrams of pattern variations in the FIG. 1 fabric.
Figure 5:
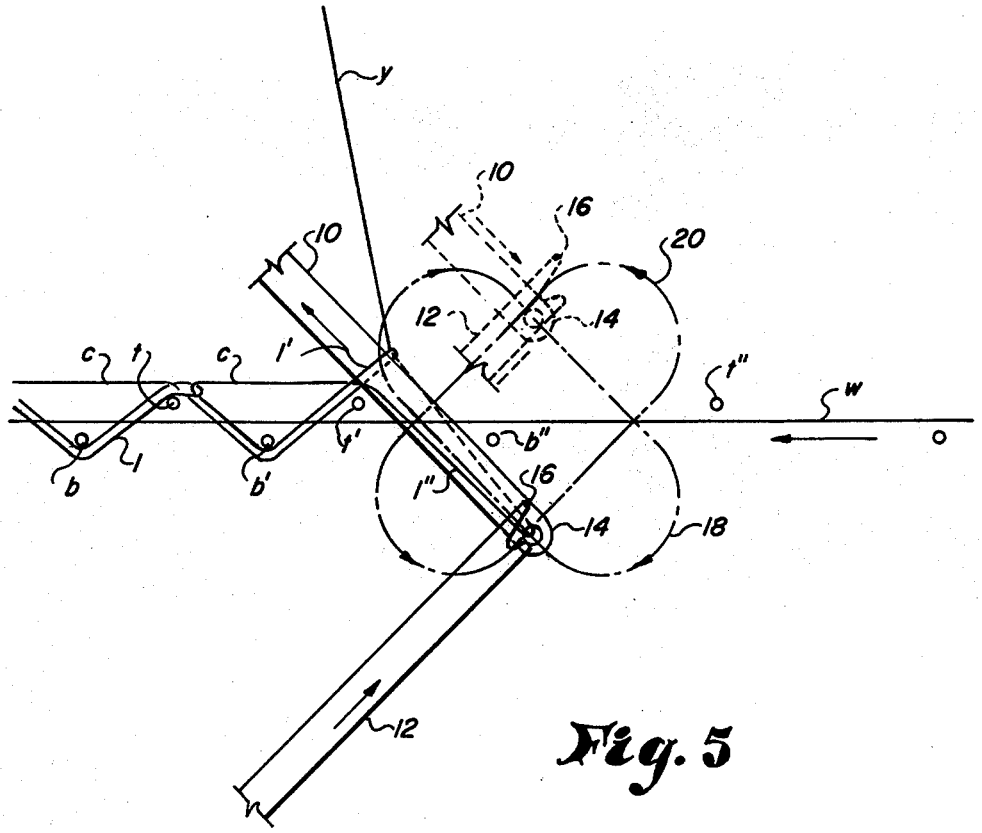
FIG. 5 is a schematic illustration of the manner in which the FIG. 1 fabric is formed.

In order to orient the FIG. 1 knit fabric diagram for direct comparison with the illustration of its formation by FIG. 5, FIG. 1 should be considered to view the fabric diagrammed at its bottom face. Accordingly, FIG. 1 should be seen as diagramming a knit fabric formed according to the present invention with an inlay of spaced warp ends *w* having top and bottom filling ends laid successively and alternately at opposite sides thereof (as at *t* and *b*), and having knitting yarns *y* warp knit into stitch chains at the spaces between the warp ends *w* so that successive loops thereof (as at l, l′ and l″) pass outside of filling ends at both sides of the warp inlay to capture the filling by sinuously interlacing it against the warp, while the stitch chains are completed by connecting segments *c* extending between successive loops entirely at the top face of the fabric.

The basic or normal knitted pattern formed in this manner has loops of the stitch chains passing outside of all filling ends at both sides of the warp inlay as diagrammed in FIG. 1, although any stitch chain loop can be elongated sufficiently to pass outside of at least two filling ends at either side of the warp inlay without interlacing with a filling end at the other side, as indicated at *lx* in FIGS. 2 and 3. Also, as indicated in FIG. 4, any weftwise row of stitch chain loops *ls* can be transferred in either direction to adjacent warp end spaces, or any weftwise series of connecting segments *cs* can be shifted to form continuing stitch chains at adjacent warp end spaces. Additional pattern varying possibilities include omitting stitch chains at certain warp end spaces, or omitting certain ends of the warp inlay, or omitting certain filling ends at either face of the fabric, or any combination of these variations, to suggest the considerable range of possibilities that exists.

Formation of the basic FIG. 1 fabric is illustrated schematically at FIG. 5 in which the warp inlay *w* having top and bottom filling ends *t* and *b* laid thereat is indicated being fed to first and second loop handling elements 10 and 12 operable to form the stitch chains at the spaces between the warp ends *w* from knitting ends *y* supplied at the top side of the warp inlay. The loop handling elements 10 and 12 are oriented in substantially perpendicular relation and are caused to orbit loop handling end portions thereof 14 and 16 symmetrically and reciprocally about a common center in respective perpendicularly related paths indicated at 18 and 20.

The loop handling end portion 14 of the first element 10 has a guide needle form for receiving a knitting end *y* and initiating the stitch chain formation therefrom, while the second element 12 has an end portion 16 of transfer finger form. Both end portions 14 and 16 are formed in any usual or suitable fashion for maintaining a loop held by either sufficiently open for penetration and taking by the other, and it should be understood, of course, that a knitting end *y* is supplied and that first and second loop handling elements 10 and 12 are provided for each warp end spacing at which a stitch chain is to be formed.

The respective orbital paths 18 and 20 of the loop handling end portions 14 and 16 are represented in FIG. 5 as having spaced parallel reaches that intersect and that are complemented by semicircular segments, and such an arrangement is preferred, although any other orbiting path can be adopted that allows loop transfer between the end portions 14 and 16 comparable to that described below. In any event, the orbital paths 18 and 20 must be related so that they intersect twice in aligned relation with the plane of the warp inlay *w*, preferably in substantial coincidence therewith as shown, and once significantly beyond the filling ends at each side of the warp inlay plane to provide transfer points at which loop handling end portions 14 and 16 effect loop transfer during each orbiting cycle to form stitch chains between the warp ends in interlaced relation with the filling as illustrated in FIG. 5.

Starting from the left in FIG. 5, a previously formed stitch chain loop *l* is represented passing below a bottom filling end *b* and then returning to the top fabric face to pass over a top filling end *t* thereat before terminating at the commencement of a first succeeding loop *l'* which, at the illustrated fabric formation stage, passes under a succeeding bottom filling *b'* and over a succeeding top filling *t'* and is held at the body portion of loop handling element 10 with a second succeeding loop *l''* extended therethrough from the end portion 14 of element 10 through which the knitting end *y* is threaded. Before reaching its illustrated full line position, the element 10 will have picked up the first succeeding loop *l'* from the transfer finger end portion 16 of element 12 as these elements pass at the upper transfer point, as indicated in dotted lines, and will have extended the second succeeding loop *l''* therethrough during travel on its downward reach, which travel will have occurred in relation to the warp and filling feeding so that loop *l''* is extended to the left of the next bottom filling *b''* in preparation for passing under it.

At the illustrated full line position of elements 10 and 12 their end portions 14 and 16 are at the bottom transfer point with the transfer finger end portion 16 about to take the extended loop *l''* from the element 10 and pass it under the bottom filling *b''* in the course of carrying it upwardly to the top transfer point for retaking thereat by the element 10 as successor to the loop *l'*. The corresponding reciprocal travel of element 10 will cause it to cast off the held loop *l'* before reaching the top transfer point to retake loop *l''* and thus the foregoing sequence is repeated to form the FIG. 1 fabric. Because the held loop *l'* and its successors are cast off at the top fabric face during each cycle, the connecting segments *c* run between the loops formed entirely at the top face.

If an elongated top face loop *lx* is desired as in FIG. 2, the cyclic operation is interrupted with the element 10 holding both loops *l'* and *l''* above the top fabric face while more than one top filling is fed past before operation is resumed, and if the elongated loop *lx* is desired at the bottom face as in FIG. 3, the interruption is effected after the element 12 has taken the loop *l''* and continued until more than one bottom filling has been fed past. Shifting of loops as at *ls* or of connecting segments as at *cs* in FIG. 4 is accomplished by respectively shogging the elements 12 or 10 at the appropriate points in the operating cycle.

Figure 6:
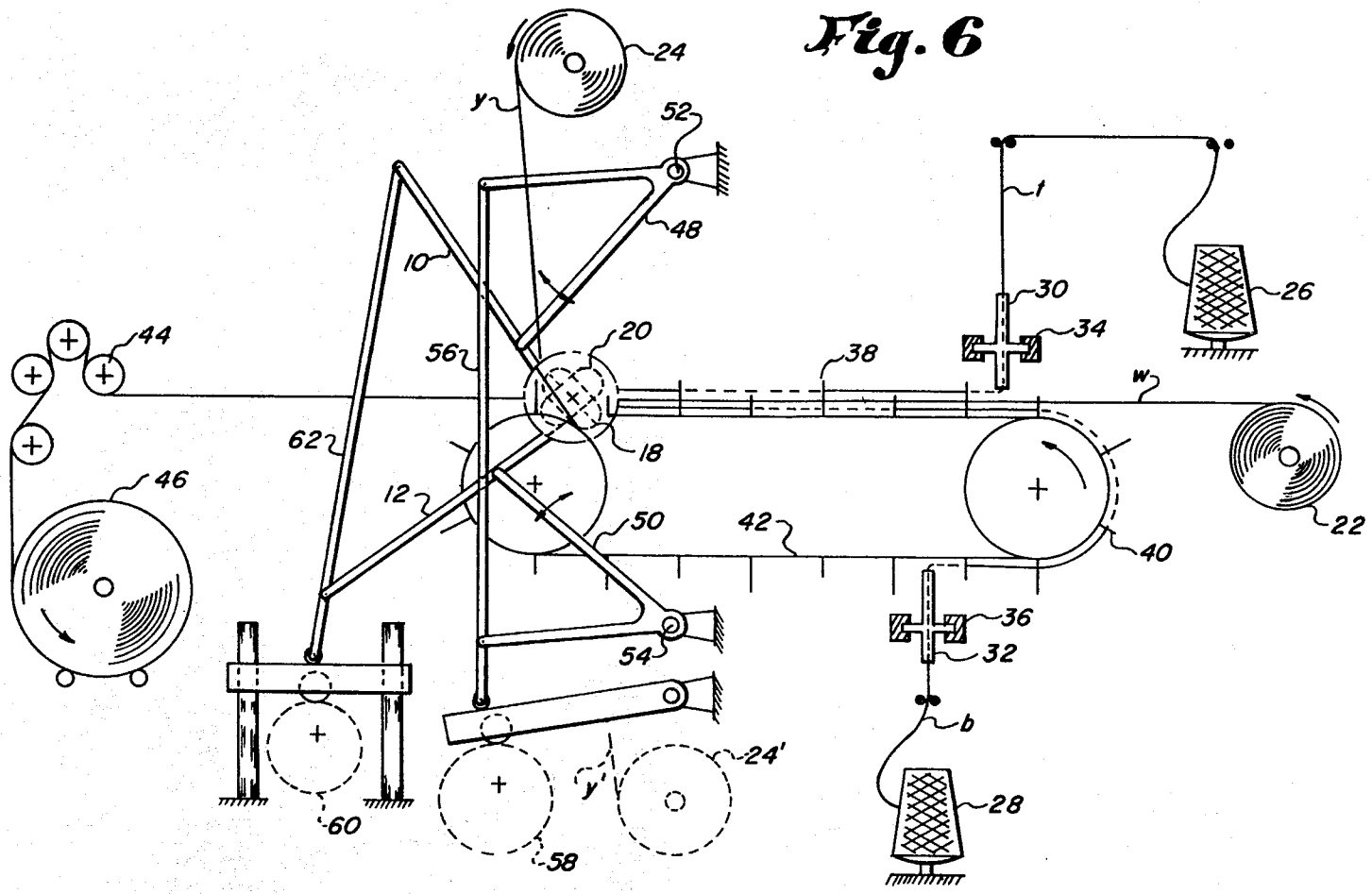
FIG. 6 is an operating diagram of warp knitting means for forming the FIG. 1 fabric.

A suitable overall arrangement of knitting means for forming the FIG. 1 fabric is diagrammed in FIG. 6 in which the loop handling elements 10 and 12 are shown extending to a broken line circle within which the end portions 14 and 16 thereof (not shown) should be understood to operate cyclically as already described in connection with FIG. 5. The warp inlay *w* is delivered to the knitting operation from a beam supply at 22 and the knitting ends *y* from a similar supply at 24, while the top and bottom filling *t* and *b* is supplied from respective cone packages at 26 and 28 through transversely reciprocated delivery tubes 30 and 32 which ride in slideways 34 and 36 and are operated to install the filling on alternate long and short pins 38 and 40 of a spaced pair of conveyor chains 42 so that filling ends *t* and *b* are extended between aligned pairs of the pins 38 or 40 above and below the warp inlay *w*. Where the filling *t* or *b* is shown in full lines in relation to the pins 38 or 40 it is meant to indicate an extension of filling between pins of the near side conveyor chain 40 of the above-noted pair, while a dotted line showing indicates a comparable far side extension, and it should be understood that the intervening extensions between the pin pairs constitute the laid filling end portions *t* and *b* that are interlaced during the knitting operation. Beyond the knitting station, the knit fabric formed is drawn off through a roll cluster at 44 and collected in a roll package at 46.

To provide the required relative motion of the loop handling elements 10 and 12 during the knitting operation each of these elements is pivotally connected intermediate its length with one leg of a bell crank 48 or 50 operating about a fixed pivot at 52 or 54 and having the other leg thereof pivotally connected with a common link 56 arranged for following the motion dictated by a cam at 58 that is suitably contoured for reciprocally actuating that component of the motion of elements 10 and 12 that is perpendicularly related. The cam 58 is represented by a dotted line circle in FIG. 6 because no attempt is made to indicate its particular contour, as such contouring follows as a matter of routine cam design for the particular motion needed which has been described in detail above. Likewise a dotted circle is shown at 60 in FIG. 6 to represent a second suitably contoured cam for actuating the lateral motion component of loop handling elements 10 and 12 through a common follower link 62 pivotally connected at their extending ends.

Figure 7:
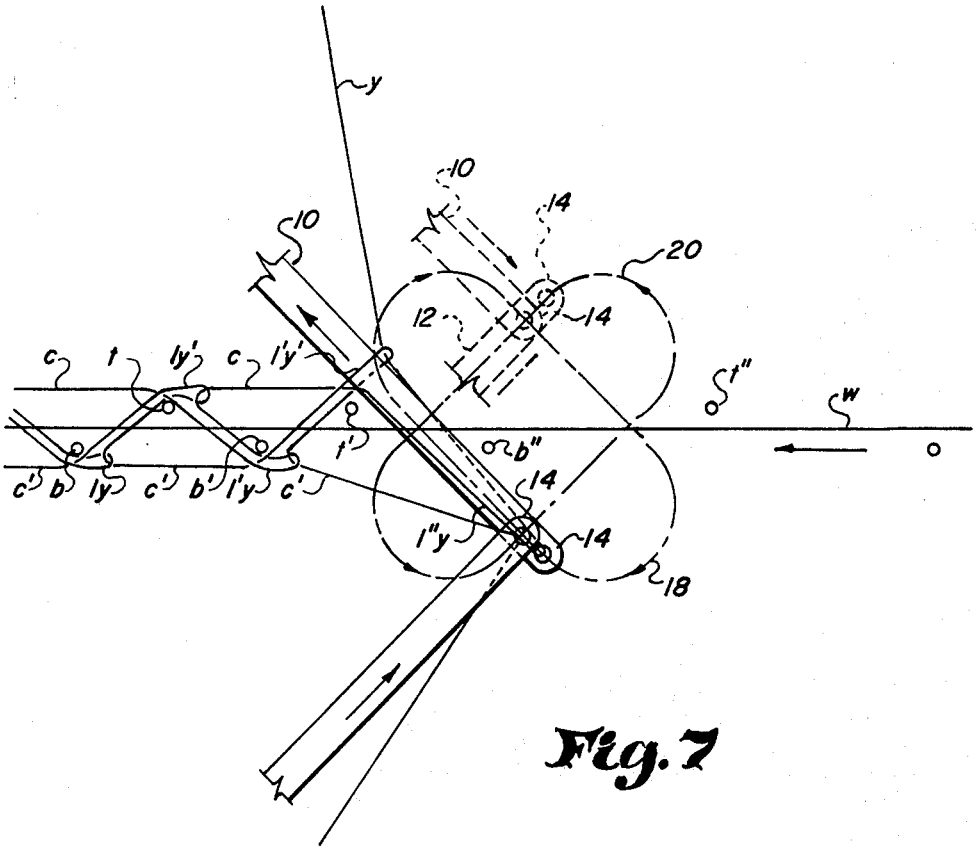
FIG. 7 is a further schematic illustration of the manner in which a modified form of knit fabric embodying the present invention is formed.

With such an arrangement it is only necessary to phase and time the cams 58 and 60 properly in order to time the motion of elements 10 and 12 for loop transfer therebetween at the top and bottom transfer points where their respective orbits intersect. It is also possible to employ a comparably arranged knitting means for forming knit fabric according to the present invention that incorporates two sets of knitting ends *y* and *y'* as illustrated in FIG. 7. In such a case, the second set of knitting ends *y* would be delivered from a beam supply 24' arranged below the knitting station as indicated in dotted lines in FIG. 6, and the only other change needed would be the provision of separate camming means for the loop handling elements 10 and 12 for the reasons to be noted below in describing the FIG. 7 knitting action.

For the FIG. 7 knitting action the loop handling elements 10 and 12 are provided as counterparts in that both have guide needle end portions 14 for respective handling of the two sets of knitting ends *y* and *y'*. Also, each element 10 and 12 takes a loop from the other, extends a succeeding loop therethrough, gives up the extended loop to the other, and casts off the taken loop, in that order, during each operating cycle so as to cooperate in forming links-links stitch chains and to require alternate overtaking acceleration between the transfer points for such cooperation, which accounts for the necessary separate camming mentioned earlier and to be noted further presently. Otherwise, however, the FIG. 7 knitting action is quite comparable to that described in connection with FIG. 5, although the links-links character of the resulting fabric involves differences in certain notable respects as will also be pointed out further below.

Considering the FIG. 7 operating cycle in detail, the loop handling element 10 is shown at the same full line position illustrated in FIG. 5 after having taken a loop $l'y'$ from the other element 12 at the top transfer point and extended a succeeding loop $l''y$ therethrough in the course of moving to its illustrated full line position where the other element 12 is now in position, after having cast off the preceding loop $l'y$ during travel through the bottom semicircular segment of its orbital path, to take the succeeding loop $l''y$ at the bottom transfer point and reciprocally execute the same operations in proceeding to its illustrated dotted line position adjacent the top transfer point. At the same time the element 10 will have moved to its illustrated dotted line position, after having cast off the loop $l'y'$ while moving through the upper semicircular portion of its orbital path, in preparation for taking a loop from the element 12 at the top transfer point.

In this latter connection, it should be noted that in moving from their respective FIG. 7 full line positions to the dotted line positions the element 10 must travel a greater distance than the element 12 (i.e., a distance greater by twice the extent to which the guide eye of the element 10 end portion 14 has not reached the bottom transfer point when that of the element 12 has), and the reverse is true as the elements 10 and 12 move from their dotted line positions to the full line ones. As a result the previously mentioned alternate overtaking acceleration of elements 10 and 12 is necessary to operate them in properly timed relation for cooperation at the transfer points, and separate camming actuation of these elements is accordingly required as also previously mentioned.

Figure 8:
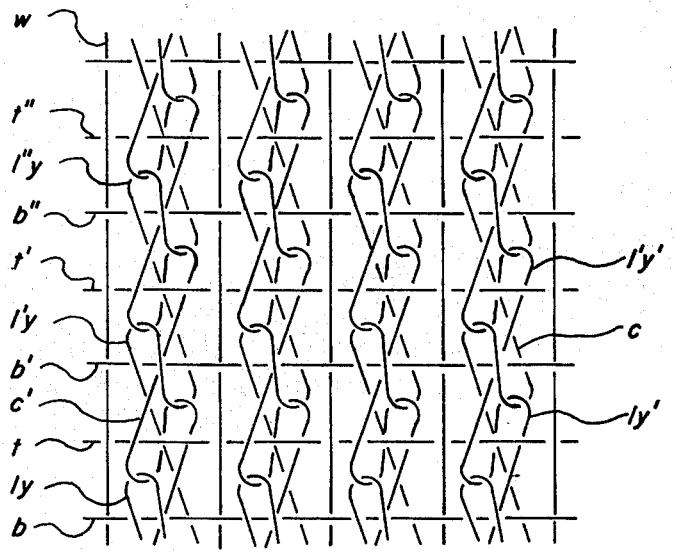
FIG. 8 is a diagram of a portion of knit fabric formed in the manner illustrated by FIG. 7.

The form of the knit fabric resulting from the FIG. 7 knitting action is indicated at the left in FIG. 7 and is diagrammed further in FIG. 8. Considering the FIG. 7 indication first, it is notable to begin with that the resulting fabric is a balanced one in the sense that its structure and consequently its appearance is exactly comparable at both faces. It is also notable that each interlacted filling end has three stitch chain segments running outside thereof and only one such segment running inside thereof, so that the filling ends are captured at a 3:1 bias tending to force them inwardly between the spaced warp ends, and as the filling ends are alternately laid at opposite warp end sides the stitch chain bias also has a secondary undulating influence on the warp ends, all of which causes the inlaid warp and filling to appear very much as if it were woven.

The foregoing features of the links-links fabric form are illustrated in both FIGS. 7 and 8, although perhaps most apparent at the left in FIG. 7 where a loop $ly$ formed from a top knitting end $y$ is shown passing under a bottom filling end $b$ below the warp inlay $w$ with a succeeding loop $ly'$ formed from a bottom knitting end $y'$ then extending therethrough to pass over a top filling end above the warp inlay $w$ and further succeeding loops $l'y$, $l'y'$ and $l''y$ arranged, or being prepared for arrangement, similarly in relation to filling ends $b'$, $t'$ and $b''$ as illustrated further in FIG. 8. The reference characters $c$ and $c'$ in FIGS. 7 and 8 designate the respective connecting segments of knitting ends $y$ and $y'$ extending between successive loops formed therefrom. The 3:1 stitch chain bias mentioned above is readily seen in both FIGS. 7 and 8 in relation to the bottom filling end $b$, for example, as being imposed by both legs of loop $ly$ and the one leg of loop $ly'$ that pass below this filling end as opposed to the single connecting segment $c$ which passes above it.

Finally, it is additionally notable that in the course of knitting action according to either FIGS. 5 or 7 the loop handling elements 10 and 12 operate during their respective upward and downward movements to "beat-up" the knit fabric as it is formed and thereby further enhance the woven simulation obtained.

The present invention has been described in detail above for purposes of illustration only and is not intended to be limited by this description or otherwise to exclude any variation or equivalent form or procedure that would be apparent from, or reasonably suggested by, the foregoing disclosure to the skill of the art.

I claim:

1. In the formation of knit fabric incorporating an inlay of spaced warp ends with filling ends laid at opposite sides of said warp ends across the full fabric width and warp knit stitch chains formed in the spaces between said warp ends, the improvement which comprises feeding said warp and filling end inlay while forming said stitch chains from knitting ends and causing loops of the stitch chains as they are formed to interlace sinuously with filling ends at both sides of the warp ends, so that the filling ends are held against the warp ends and are forced inwardly therebetween causing both warp and filling ends to undulate as a result of mutual interaction in a manner producing an appearance approaching that of woven structure.

2. In the formation of knit fabric, the improvement defined in claim 1 wherein said warp knit stitch chains are formed by feeding knitting ends therefor at one side of said warp ends while extending looped portions of said knitting ends between said warp ends and between filling ends laid thereat, taking said looped knitting end portions at the other warp end side and causing the same to pass over a filling end at said other side while returning them to the first warp end side at which the knitting ends therefor are fed, receiving the returned looped portions at said first warp end side and holding the same for casting off at a disposition passing over a filling end at said first side, and casting off the held looped portions at said first warp end side after extending a succeeding looped portion through each such held portion and having the succeeding extended portion taken at the other warp end side.

3. In the formation of knit fabric, the improvement defined in claim 1 wherein said warp knit stitch chains are formed as links-links stitch chains at the spaces between said warp ends from knitting ends fed at opposite sides of said warp ends, while causing said filling ends to be successively captured at the side of said warp ends at which they are laid by a weft-wise row of stitch chain loops formed from the knitting ends fed at the opposite warp end side.

4. In knitting apparatus in which means is provided for inlaying spaced warp ends and laying filling ends at opposite sides thereof across the full fabric width, together with further means for feeding knitting ends to form warp knit stitch chains in the spaces between said warp ends, the improvement which comprises means operable to form said stitch chains including first and second loop handling elements oriented in substantially perpendicular relation and caused to orbit loop handling end portions thereof symmetrically and reciprocally about a common center in respective perpendicularly related paths intersecting twice in aligned relation with the plane of said warp inlay and once significantly beyond said filling ends at each side of said warp inlay plane during each orbital cycle, said loop handling end portions being formed and the respective orbiting thereof being timed for loop transfer therebetween at the points of intersection of said orbiting paths at each side of said warp inlay plane.

5. In knitting apparatus, the improvement defined in claim 4 wherein the respective orbiting paths of said loop handling elements each have spaced parallel reaches at which said paths intersect and the intersections of said paths in aligned relation with the plane of said warp inlay substantially coincide with said plane.

6. In knitting apparatus, the improvement defined in claim 4 wherein at least one of said loop handling elements has a guide needle form at the loop handling end portion thereof for receiving a knitting end to form a stitch chain from a knitting end supply at one side of said warp inlay.

7. In knitting apparatus, the improvement defined in claim 4 wherein said first loop handling element has a guide needle form at the loop handling end portion thereof and the loop handling end portion of the second loop handling element has a transfer finger form, said first loop handling element being operated to form a loop in a knitting end received thereat from a supply at one side of said warp inlay incident to extending the received knitting end between warp ends of said inlay and between filling ends laid thereat, said second loop handling element being operated to take the loop thus formed upon extension thereof between said warp and filling ends and return the same to the warp inlay side at which the knitting end is supplied while causing the loop to pass over a filling end at the opposite warp inlay side as it is returned to the knitting end supply side, and said first loop handling element being further operable to retake the returned loop and hold the same for casting off at a disposition passing over a filling end at the knitting end supply side of the warp inlay after a succeeding loop is extended through the held loop and the succeeding loop is taken by said second loop handling element at said opposite warp inlay side.

8. In knitting apparatus, the improvement defined in claim 4 wherein said first and second loop handling elements each have a guide needle form at the loop handling end portions thereof and are reciprocally operated to form loops in knitting ends respectively received thereat from supplies at opposite sides of said warp inlay incident to alternately extending the received knitting ends between warp ends of said inlay and between filling ends laid thereat, said loop handling elements being further operated to take each loop thus formed by the other element upon extension thereof between said warp and filling ends and cause the taken loop to pass over a filling end at the adjacent warp inlay side while extending a succeeding loop therethrough to the opposite warp inlay side, and said loop handling elements being additionally operated reciprocally to cast off the taken loops alternately after they have extended a succeeding loop therethrough and this succeeding loop has been taken by the other element.

* * * * *